US009812248B2

(12) United States Patent
Skinner et al.

(10) Patent No.: US 9,812,248 B2
(45) Date of Patent: Nov. 7, 2017

(54) IGNITION COIL

(71) Applicant: DELPHI TECHNOLOGIES, INC., Troy, MI (US)

(72) Inventors: Albert A. Skinner, Waterford, MI (US); Colin Hamer, Noblesville, IN (US); Harry O. Levers, Jr., Clarkston, MI (US)

(73) Assignee: DELPHI TECHNOLOGIES, INC., Troy, MI (US)

( * ) Notice: Subject to any disclaimer, the term of this patent is extended or adjusted under 35 U.S.C. 154(b) by 221 days.

(21) Appl. No.: 14/739,094

(22) Filed: Jun. 15, 2015

(65) Prior Publication Data

US 2015/0364246 A1 Dec. 17, 2015

Related U.S. Application Data

(60) Provisional application No. 62/012,557, filed on Jun. 16, 2014.

(51) Int. Cl.

| | |
|---|---|
| ***H01F 27/29*** | (2006.01) |
| ***H01F 27/32*** | (2006.01) |
| ***H01F 38/12*** | (2006.01) |
| *H01F 5/02* | (2006.01) |

(52) U.S. Cl.

CPC ..... *H01F 27/325* (2013.01); *H01F 27/29* (2013.01); *H01F 38/12* (2013.01); *H01F 2005/025* (2013.01)

(58) Field of Classification Search

CPC ..... H01F 27/00–27/30
USPC ..... 336/65, 83, 90, 92, 96, 107, 192, 336/220–223

See application file for complete search history.

(56) References Cited

U.S. PATENT DOCUMENTS

| | | | | |
|---|---|---|---|---|
| 4,388,568 | A | 6/1983 | Goseberg et al. | |
| 5,929,736 | A | 7/1999 | Sakamaki et al. | |
| 6,060,973 | A | 5/2000 | Kawano et al. | |
| 6,244,526 | B1 * | 6/2001 | Schuldt | F02M 51/0671 239/585.1 |
| 6,556,118 | B1 | 4/2003 | Skinner | |
| 6,845,764 | B1 | 1/2005 | Skinner et al. | |
| 2009/0260608 | A1 * | 10/2009 | Fujiyama | H01F 3/00 123/634 |
| 2013/0291844 | A1 | 11/2013 | Skinner et al. | |

* cited by examiner

*Primary Examiner* — Tuyen Nguyen
(74) *Attorney, Agent, or Firm* — Joshua M. Haines

(57) ABSTRACT

An ignition coil for delivering a spark-generating current to a spark plug includes a magnetically-permeable core; a primary winding disposed outward of the core; and a secondary winding radially surrounding the primary winding and inductively coupled to the primary winding, the secondary winding having a low-voltage end and a high-voltage end. The secondary winding includes a secondary winding first section proximal to the low-voltage end and having a first thickness. The secondary winding also includes a secondary winding second section proximal to the high-voltage end and having a second thickness that is less than the first thickness of the secondary winding first section.

14 Claims, 2 Drawing Sheets

IGNITION COIL

CROSS-REFERENCE TO RELATED PATENT APPLICATIONS

This patent application claims the benefit of U.S. provisional patent application Ser. No. 62/012,557 filed on Jun. 16, 2014, the disclosure of which is hereby incorporated by reference in its entirety.

TECHNICAL FIELD OF INVENTION

The present invention relates to an ignition coil for developing a spark-generating current that is applied to a spark plug and more particularly to such an ignition coil with a secondary winding which maintains an acceptable wire to wire voltage when subjected to a current pulse.

BACKGROUND OF INVENTION

Ignition coils are known for use in connection with an internal combustion engine such as an automobile engine. Ignition coils typically include a core around which is wound a primary winding. A secondary winding is wound around a secondary winding spool to surround the primary winding such that a high voltage is induced on the secondary winding when an electric current applied to the primary winding is stopped. One end of the secondary winding is a low-voltage end which is connected to a ground terminal while the other end of the secondary winding is a high-voltage end which is connected to a high-voltage terminal which is in electrical communication with a spark plug, thereby delivering a spark-generating current to the spark plug. Delivering the spark-generating current to the spark plug results in the first several hundred turns of the high-voltage end of the secondary winding being subjected to a high current pulse. Unless the high current pulse is properly dealt with, the secondary winding may be undesirably affected by the high current pulse.

The high current pulse is most easily limited by using a high resistance spark plug. High resistance spark plugs were common in less-recent internal combustion engines, and consequently, the high current pulse was not of sufficient magnitude to need to be factored into the secondary winding design. However, more modern internal combustion engines are commonly utilizing lower resistance spark plugs in order to boost energy from the coil, thereby resulting in higher voltages and making the high current pulse a magnitude that may not be compatible with the secondary winding.

Another way to deal with the high current pulse is to wind the secondary winding in a segmented winding strategy where a plurality of axially spaced ribs on the secondary winding spool forms a plurality of channels therebetween. Consequently, the secondary winding is divided into segments where the potential difference is minimized between the outermost windings of a given segment and the innermost windings of the given segment. As a result, the potential difference is kept to an acceptable level between the outermost winding and the innermost winding at the high-voltage end of the secondary winding that is subjected to the high current pulse. An example of a secondary winding using such a segmented winding strategy is shown in United States Patent Application Publication No. US 2013/0291844 to Skinner et al., the disclosure of which is incorporated herein by reference in its entirety.

While the segmented winding strategy of United States Patent Application Publication No. US 2013/0291844 to Skinner et al. may be effective for dealing with the high current pulse, it may be desirable to use a progressive winding strategy where the secondary winding is wound uninterrupted around the secondary winding spool. Using the progressive winding strategy may be more desirable than the segmented winding strategy because the axial spaced ribs used to implement the segmented winding strategy add stress to the secondary winding spool and thereby require the secondary winding spool to be made of special material under some circumstances. The progressive winding strategy may be less costly to manufacture due at least in part to requiring less costly material, furthermore, the progressive winding strategy may allow the ignition coil to be made more compact which is particularly important when the ignition coil is a plug-top coil. However, since the progressive winding strategy is wound uninterrupted around the secondary winding spool, the potential difference between the outermost winding and the innermost winding is greater than in the segmented winding strategy. In order to minimize the potential difference between the outermost winding and the innermost winding in the progressive winding, the secondary winding may be increased in axial length, thereby decreasing the thickness of the secondary winding by spreading the number of windings over a greater length, however, this may not be possible to do while maintaining a desired packaging size of the ignition coil. An example of a secondary winding using such a progressive winding strategy is shown in U.S. Pat. No. 6,556,118 to Skinner et al., the disclosure of which is incorporated herein by reference in its entirety.

What is needed is an ignition coil which minimizes or eliminates one or more of the shortcomings as set forth above.

SUMMARY OF THE INVENTION

Briefly described, an ignition coil is provided for delivering a spark-generating current to a spark plug. The ignition coil includes a magnetically-permeable core; a primary winding disposed outward of the core; and a secondary winding radially surrounding the primary winding and inductively coupled to the primary winding, the secondary winding having a low-voltage end and a high-voltage end. The secondary winding includes a secondary winding first section proximal to the low-voltage end and having a first thickness. The secondary winding also includes a secondary winding second section proximal to the high-voltage end and having a second thickness that is less than the first thickness of the secondary winding first section. By having the second thickness less than the first thickness, the potential difference between the outermost winding and the innermost winding, i.e. wire to wire voltage, at the high voltage end can be maintained at an acceptable level while minimizing the axial length of the secondary winding and also minimizing the packaging size of the ignition coil.

Further features and advantages of the invention will appear more clearly on a reading of the following detailed description of the preferred embodiment of the invention, which is given by way of non-limiting example only and with reference to the accompanying drawings.

BRIEF DESCRIPTION OF DRAWINGS

This invention will be further described with reference to the accompanying drawings in which.

DETAILED DESCRIPTION OF INVENTION

Figure 1:
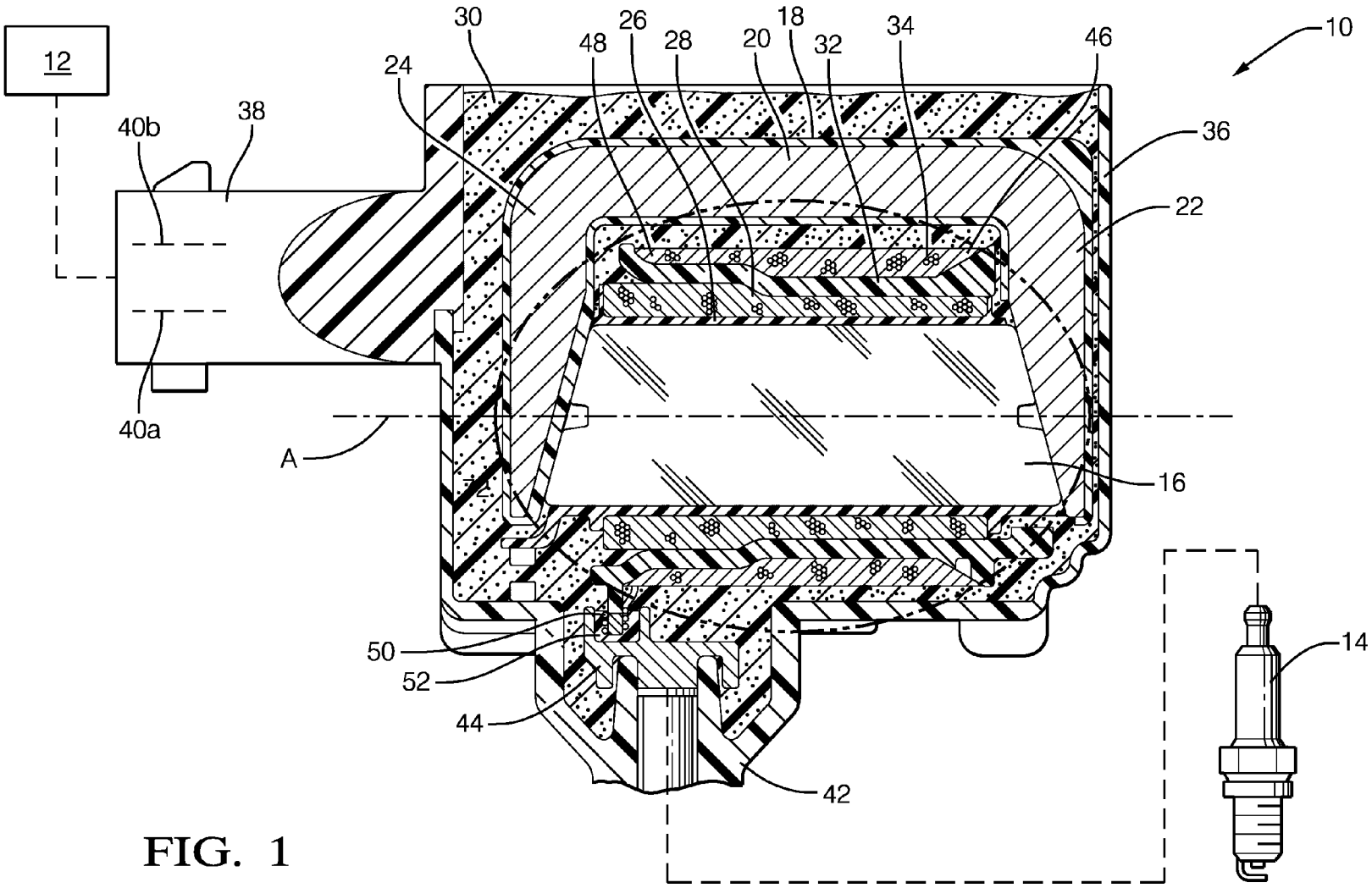
FIG. 1 is a simplified cross-section view of an ignition coil in accordance with the present invention.

Reference will first be made to FIG. 1 which shows a simplified cross-sectional view of an ignition coil 10. Ignition coil 10 may be controlled by a control unit 12 or the like. Ignition coil 10 is configured for connection to a spark plug 14 that is in threaded engagement with a spark plug opening (not shown) in an internal combustion engine (also not shown). Ignition coil 10 is configured to deliver a high-voltage spark-generating current to spark plug 14, as shown. Generally, overall spark timing (dwell control) and the like is provided by control unit 12. One ignition coil 10 may be provided per spark plug 14.

Ignition coil 10 may include a magnetically-permeable core 16, a magnetically-permeable structure 18, hereinafter referred to as high-permeance structure 18, configured to provide a high permeance magnetic return path which has a base section 20 and a pair of legs 22 and 24, a primary winding spool 26, a primary winding 28, a quantity of encapsulant 30 such as an epoxy potting material, a secondary winding spool 32, a secondary winding 34, a case 36, a low-voltage connector body 38 having primary terminals 40*a*, 40*b* (shown in FIG. 1 as hidden lines), a high-voltage tower 42, and a high-voltage terminal 44.

Core 16 extends along a core longitudinal axis A. Core 16 may be made of laminated steel plates, compression molded insulated iron particles, or other appropriate material. Core 16 may be any cross-sectional shape known to those of ordinary skill in the art, for example only, oval or circular.

Primary winding spool 26 is configured to receive and retain primary winding 28. Primary winding spool 26 is disposed adjacent to and radially outward of core 16 and is preferably in coaxial relationship therewith. Primary winding spool 26 may comprise any one of a number of conventional spool configurations known to those of ordinary skill in the art. In the illustrated embodiment, primary winding spool 26 is configured to receive one continuous primary winding. Primary winding spool 26 may be formed generally of electrical insulating material having properties suitable for use in a relatively high temperature environment. For example, primary winding spool 26 may comprise plastic material such as PPE/PS (e.g., NORYL® available from SABIC) or polybutylene terephthalate (PBT) thermoplastic polyester. It should be understood that there are a variety of alternative materials that may be used for primary winding spool 26.

Primary winding 28, as described above, is wound onto primary winding spool 26. Primary winding 28 includes first and second ends that are connected to the primary terminals 40*a*, 40*b* in low-voltage connector body 38. Primary winding 28 is configured to carry a primary current $I_P$ for charging ignition coil 10 upon control of control unit 12. Primary winding 28 may comprise copper, insulated magnet wire, with a size typically between about 20-23 AWG. Further features of primary winding 28 will be described in greater detail later.

Secondary winding spool 32 is configured to receive and retain secondary winding 34. Secondary winding spool 32 is disposed adjacent to and radially outward of the central components comprising core 16, primary winding spool 26 and primary winding 28 and, preferably, is in coaxial relationship therewith. Secondary winding spool 32 is configured to receive secondary winding 34 in a continuous winding strategy (e.g., progressive winding) where secondary winding 34 is wound uninterrupted around secondary winding spool 32. Secondary winding spool 32 may be formed generally of electrical insulating material having properties suitable for use in a relatively high temperature environment. For example, secondary winding spool 32 may comprise plastic material such as PPE/PS (e.g., NORYL available from SABIC) or polybutylene terephthalate (PBT) thermoplastic polyester. It should be understood that there are a variety of alternative materials that may be used for secondary winding spool 32. Further features of secondary winding spool 32 will be described in greater detail later.

Secondary winding 34 includes a low-voltage end 46 and a high-voltage end 48. Low-voltage end 46 may be electrically connected to a low-voltage terminal (not shown) within case 36 which is connected to ground by way of a ground connection through low-voltage connector body 38. High-voltage end 48 is electrically connected to high-voltage terminal 44 through a high-voltage end termination 50 which is disposed within electrically conductive epoxy 52 which is electrical contact with high-voltage terminal 44. Alternatively, high-voltage end termination 50 may be connected to high-voltage terminal 44 with a soldered connection or other known connection method. Secondary winding 34 may be implemented using conventional material (e.g. copper, insulated magnet wire) known to those of ordinary skill in the art. Further features of secondary winding 34 will be described in greater detail later.

High-permeance structure 18 is configured to provide a high permeance magnetic return path for the magnetic flux produced in core 16 during operation of ignition coil 10. High-permeance structure 18 may be formed, for example, from a stack of silicon steel laminations or other adequate magnetic material. As described previously, high-permeance structure 18 includes base section 20 and a pair of legs 22 and 24. Core 16 is positioned between legs 22 and 24 such that core longitudinal axis A passes through legs 22 and 24. One end of core 16 mates with leg 22 while the other end of core 16 forms a gap with leg 24 where the gap may be in a range of, for example only, about 0.5 mm to 2 mm. Further features of high-permeance structure 18 are described in United States Patent Application Publication No. 2013/0291844 A1 to Skinner et al., the disclosure of which is incorporated herein by reference in its entirety.

Encapsulant 30 may be suitable for providing electrical insulation within ignition coil 10. In a preferred embodiment, encapsulant 30 may comprise an epoxy potting material. Sufficient encapsulant 30 is introduced in ignition coil 10, in the illustrated embodiment, to substantially fill the interior of case 36. Encapsulant 30 also provides protection from environmental factors which may be encountered during the service life of ignition coil 10. There are a number of encapsulant materials known in the art.

Figure 2:
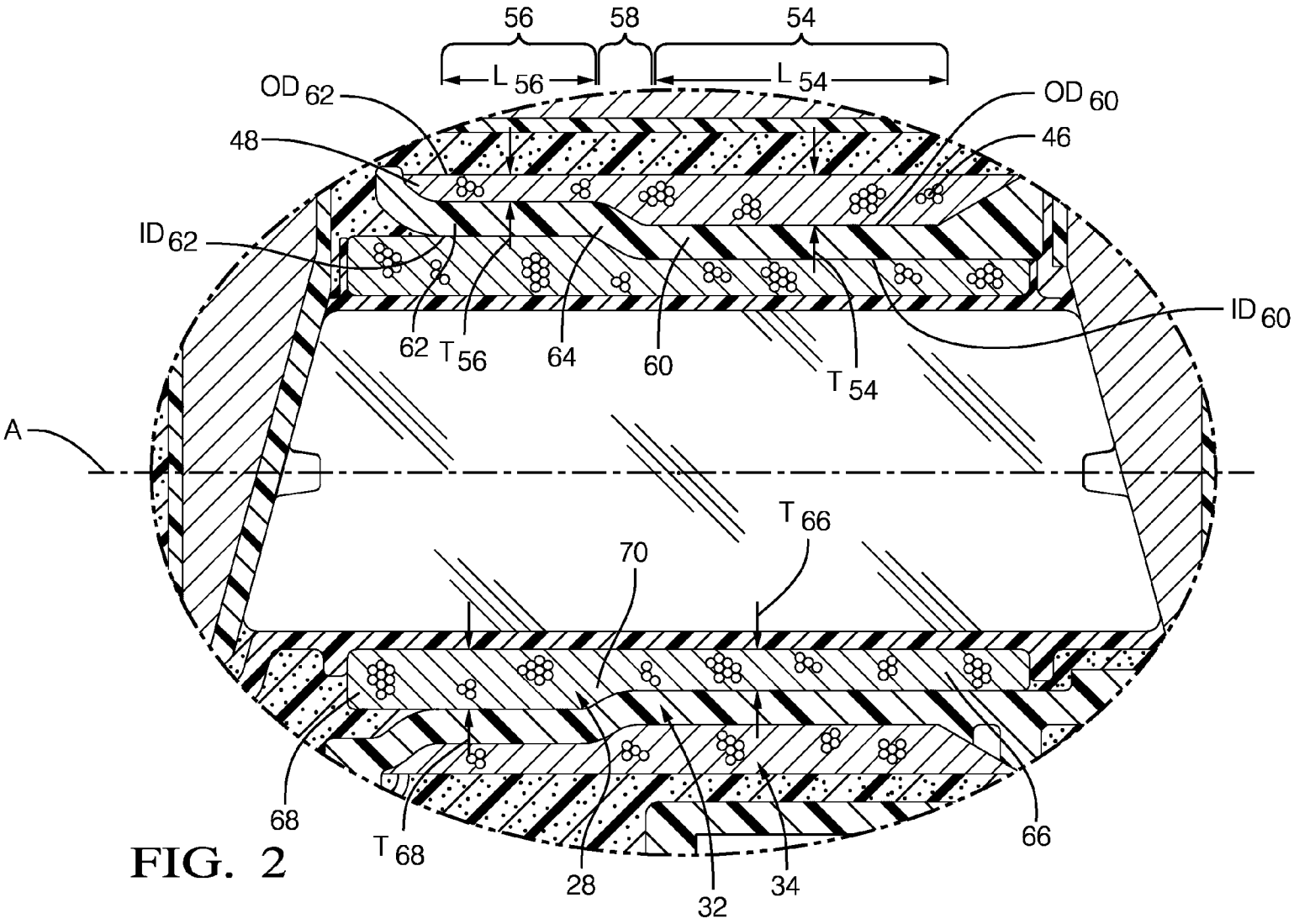
FIG. 2 is an enlarged portion of FIG. 1.

Reference will continue to be made to FIG. 1 and additional reference will now be made to FIG. 2 which shows an enlarged portion of primary winding 28, secondary winding spool 32, and secondary winding 34. Secondary winding 34 includes a secondary winding low-voltage section 54, hereinafter referred to as secondary winding first section 54, that is proximal to low-voltage end 46. Secondary winding first section 54 has a substantially uniform thickness $T_{54}$ in the radial direction and a length $L_{54}$ in the direction of axis A. Secondary winding 34 also includes a secondary winding high-voltage section 56, hereinafter referred to as secondary winding second section 56, that is proximal to high-voltage end 48. Secondary winding second section 56 has a substantially uniform thickness $T_{56}$ in the radial direction and a length $L_{56}$ in the direction of axis A such that thickness $T_{56}$ is less than thickness $T_{54}$. Consequently, secondary winding second section 56 has fewer layers of windings in the radial direction than secondary winding first section 54 has in the radial direction. A secondary winding third section 58 may connect secondary winding first section 54 to secondary winding second section 56 such that the thickness in the radial direction of secondary winding third section 58 tapers from thickness $T_{54}$ to thickness $T_{56}$ in a substantially uniform manner. Length $L_{56}$ and thickness $T_{56}$ are selected to achieve an acceptable potential difference (i.e. wire to wire voltage) between the outermost winding of secondary winding 34 and the innermost winding of secondary winding 34 when subjected to a high current pulse when ignition coil 10 supplies the spark-generating current to spark plug 14. Length $L_{54}$ and length $L_{56}$ are preferably each at least 5% of the total length of secondary winding 34.

Secondary winding spool 32 may be configured to achieve the difference in thickness $T_{54}$ and thickness $T_{56}$. More specifically, secondary winding spool 32 may include a secondary winding spool first section 60 having an outside diameter $OD_{60}$ around which secondary winding first section 54 is wound and an inside diameter $ID_{60}$ that is radially inward of outside diameter $OD_{60}$. Secondary winding spool 32 may also include a secondary winding spool second section 62 having an outside diameter $OD_{62}$ around which secondary winding second section 56 is wound and an inside diameter $ID_{62}$ that is radially inward of outside diameter $OD_{62}$. Secondary winding spool 32 may also include a secondary winding spool third section 64 which tapers from outside diameter $OD_{60}$ to outside diameter $OD_{62}$ around which secondary winding third section 58 is wound. Outside diameter $OD_{62}$ is larger than outside diameter $OD_{60}$, and consequently, when secondary winding 34 is wound on secondary winding spool 32, secondary winding 34 may have an external diameter that is substantially uniform for the entire length of secondary winding 34 in order to allow thickness $T_{56}$ to be less than thickness $T_{54}$.

Inside diameter $ID_{62}$ of secondary winding spool second section 62 may be greater than inside diameter $ID_{60}$ of secondary winding spool first section 60, consequently, primary winding 28 may include a primary winding first section 66 that is radially surrounded by secondary winding spool inside diameter $ID_{60}$ of secondary winding spool first section 60 and a primary winding second section 68 that is radially surrounded by inside diameter $ID_{62}$ of secondary winding spool second section 62. As a result, primary winding first section 66 has a substantially uniform thickness $T_{66}$ in the radial direction while primary winding second section 68 has a substantially uniform thickness $T_{68}$ in the radial direction which is greater than thickness $T_{66}$. A primary winding third section 70 connects primary winding first section 66 to primary winding second section 68, and consequently, primary winding third section 70 tapers from thickness $T_{66}$ to thickness $T_{68}$. Since inside diameter $ID_{62}$ of secondary winding spool second section 62 is greater than inside diameter $ID_{60}$ of secondary winding spool first section 60, primary winding 28 can include more windings than if inside diameter $ID_{62}$ was the same as inside diameter $ID_{60}$, thereby increasing the efficiency of ignition coil 10.

By having thickness $T_{56}$ of secondary winding second section 56 less than thickness $T_{54}$ of secondary winding first section 54, the potential difference between the outermost winding and the innermost winding at high-voltage end 48 of secondary winding 34 can be maintained at an acceptable level while minimizing the axial length of the secondary winding 34 and also minimizing the packaging size of the ignition coil 10.

While secondary winding spool 32 has been illustrated as having outside diameter $OD_{60}$ and outside diameter $OD_{62}$ which is larger than outside diameter $OD_{60}$, it should now be understood that secondary winding spool 32 may have a substantially uniform outside diameter (not shown), i.e. outside diameter $OD_{60}$ and outside diameter $OD_{62}$ are equal, around which secondary winding first section 54 and secondary winding second section 56 are wound. When secondary winding first section 54 and secondary winding second section 56 are wound around a portion of secondary winding spool 32 that is uniform in diameter, thickness $T_{56}$ of secondary winding second section 56 that is less than thickness $T_{54}$ of secondary winding first section 54 is achieved by simply winding secondary winding first section 54 with more windings than secondary winding second section 56.

While secondary winding 34 has been illustrated with two sections of differing thicknesses, i.e. secondary winding first section 54 and secondary winding second section 56, it should now be understood that one or more additional sections of distinct thickness may be provided.

While a specific configuration of ignition coil 10 has been described, it should be understood that the present invention is applicable for use in a variety of ignition coil configurations.

While this invention has been described in terms of preferred embodiments thereof, it is not intended to be so limited, but rather only to the extent set forth in the claims that follow.

We claim:

1. An ignition coil for delivering a spark-generating current to a spark plug; said ignition coil comprising:

a magnetically-permeable core;

a primary winding disposed outward of said core; and a secondary winding radially surrounding said primary winding and inductively coupled to said primary winding, said secondary winding having a low-voltage end and a high-voltage end;

wherein said secondary winding includes a secondary winding first section proximal to said low-voltage end and having a secondary winding first thickness and wherein said secondary winding also has a secondary winding second section proximal to said high-voltage end and having a secondary winding second thickness that is less than said secondary winding first thickness.

2. An ignition coil as in claim 1 wherein said secondary winding first thickness is substantially uniform and said secondary winding second thickness is substantially uniform.

3. An ignition coil as in claim 1 where said secondary winding includes a secondary winding third section between said secondary winding first section and said secondary winding second section, said secondary winding third section tapering in thickness from said secondary winding first thickness to said secondary winding second thickness.

4. An ignition coil as in claim 3 wherein said secondary winding has a substantially uniform external diameter over said secondary winding first section, said secondary winding second section, and said secondary winding third section.

5. An ignition coil as in claim 1 wherein said secondary winding has a substantially uniform external diameter over said secondary winding first section and said secondary winding second section.

6. An ignition coil as in claim 1 further comprising a secondary winding spool, wherein:

said secondary winding spool has a secondary winding spool first section around which said secondary winding first section is wound, said secondary winding spool first section having a first outside diameter;

said secondary winding spool has a secondary winding spool second section around which said secondary winding second section is wound, said secondary winding spool second section having a second outside diameter which is larger than said first outside diameter.

7. An ignition coil for delivering a spark-generating current to a spark plug; said ignition coil comprising:

a magnetically-permeable core;

a primary winding disposed outward of said core;

a secondary winding radially surrounding said primary winding and inductively coupled to said primary winding, said secondary winding having a low-voltage end and a high-voltage end; and a secondary winding spool; wherein:

said secondary winding includes a secondary winding first section proximal to said low-voltage end and having a secondary winding first thickness and wherein said secondary winding also has a secondary winding second section proximal to said high-voltage end and having a secondary winding second thickness that is less than said secondary winding first thickness;

said secondary winding spool has a secondary winding spool first section around which said secondary winding first section is wound, said secondary winding spool first section having a first outside diameter;

said secondary winding spool has a secondary winding spool second section around which said secondary winding second section is wound, said secondary winding spool second section having a second outside diameter which is larger than said first outside diameter;

said secondary winding spool first section has a first inside diameter; and said secondary winding spool second section has a second inside diameter which is larger than said first inside diameter.

8. An ignition coil as in claim 7 wherein:

said primary winding has a primary winding first section which is radially surrounded by said first inside diameter and which is substantially uniform in thickness;

said primary winding has a primary winding second section which is radially surrounded by said second inside diameter and which is substantially uniform in thickness.

9. An ignition coil as in claim 8 wherein said primary winding second section is thicker than said primary winding first section.

10. An ignition coil as in claim 9 wherein said primary winding has a primary winding third section which is between said primary winding first section and said primary winding third section and which tapers in thickness from said primary winding first section to said primary winding second section.

11. An ignition coil as in claim 1 wherein:

said primary winding includes a primary winding first section having a primary winding first thickness; and said primary winding has a primary winding second section having a primary winding second thickness that is greater than said primary winding first thickness.

12. An ignition coil for delivering a spark-generating current to a spark plug; said ignition coil comprising:

a magnetically-permeable core;

a primary winding disposed outward of said core; and a secondary winding radially surrounding said primary winding and inductively coupled to said primary winding, said secondary winding having a low-voltage end and a high-voltage end; wherein:

said secondary winding includes a secondary winding first section proximal to said low-voltage end and having a secondary winding first thickness and wherein said secondary winding also has a secondary winding second section proximal to said high-voltage end and having a secondary winding second thickness that is less than said secondary winding first thickness;

said primary winding includes a primary winding first section having a primary winding first thickness;

said primary winding has a primary winding second section having a primary winding second thickness that is greater than said primary winding first thickness;

said secondary winding first section radially surrounds said primary winding first section; and said secondary winding second section radially surrounds said primary winding second section.

13. An ignition coil for delivering a spark-generating current to a spark plug; said ignition coil comprising:

a magnetically-permeable core;

a primary winding disposed outward of said core; and a secondary winding radially surrounding said primary winding and inductively coupled to said primary winding, said secondary winding having a low-voltage end and a high-voltage end; wherein:

said secondary winding includes a secondary winding first section proximal to said low-voltage end and having a secondary winding first thickness and wherein said secondary winding also has a secondary winding second section proximal to said high-voltage end and having a secondary winding second thickness that is less than said secondary winding first thickness;

said primary winding includes a primary winding first section having a primary winding first thickness;

said primary winding has a primary winding second section having a primary winding second thickness that is greater than said primary winding first thickness;

said secondary winding first thickness is substantially uniform;

said secondary winding second thickness is substantially uniform;

said primary winding first thickness is substantially uniform; and said primary winding second thickness is substantially uniform.

14. An ignition coil as in claim 13 wherein:

said secondary winding first section radially surrounds said primary winding first section; and said secondary winding second section radially surrounds said primary winding second section.

* * * * *